United States Patent [19]

Pappert

[11] 3,934,656

[45] Jan. 27, 1976

[54] AUTOMATIC HYDRAULIC HAMMER

[76] Inventor: Joseph A. Pappert, 140 Myrtle Ave., Turnersville, N.J. 08012

[22] Filed: Nov. 1, 1973

[21] Appl. No.: 412,019

[52] U.S. Cl. ..... 173/124; 74/110; 74/160; 173/126; 173/132

[51] Int. Cl.[2] ..... B25D 9/00

[58] Field of Search ..... 173/124, 84, 53, 59, 126, 173/127; 74/110

[56] References Cited

UNITED STATES PATENTS

| | | | |
|---|---|---|---|
| 224,483 | 2/1880 | Segur | 173/84 |
| 841,032 | 1/1907 | Mellgren | 173/124 X |
| 2,559,478 | 7/1951 | Stone | 173/124 X |
| 2,787,123 | 4/1957 | Delvaux | 173/127 X |
| 3,039,546 | 6/1962 | Janson et al. | 173/124 |

*Primary Examiner*—Frank L. Abbott
*Assistant Examiner*—William F. Pate, III

[57] ABSTRACT

An automatic hydraulic hammer including a frame with suitable mountings to attach the frame to an existing hydraulic feed test boring drill machine. A weighted hammer is reciprocal within the frame through a measured distance and is arranged for substantially frictionless operation. A hydraulic cylinder mounts upon the frame and receives its power from the hydraulic test boring drill machine. A plunger is responsive to function of the hydraulic cylinder and terminates downwardly in an arrow-shaped head which releasably connects to a plurality of pivotally mounted clamps. When the head engages the clamps, the hydraulic cylinder is functioned to raise the plunger and the releasably attached hammer through a known distance. The top of the frame is provided with a plurality of depending fingers which function with the clamps to quickly and positively release the head at the top of the hammer travel. The release of the hammer permits a free fall within the guide frame through a known distance in accordance with standard penetration test procedures.

8 Claims, 4 Drawing Figures

AUTOMATIC HYDRAULIC HAMMER

BACKGROUND OF THE INVENTION

The present invention relates generally to soil test apparatus, and more particularly, is directed to an automatic hydraulic hammer which is compatible with and which can be employed in conjunction with existing hydraulic feed test boring drill machines.

In the construction industry, it is common practice to investigate underground soil and rock formations in order to properly evaluate site conditions in order to properly design foundations for structures such as buildings and roads. In conducting such investigations, various code officials and standard associations, such as the American Society for Testing and Materials have attempted to develop standard sampling procedures to establish reliable data concerning such engineering properties of soil as plasticity, permeability, unit weight, compressibility, strength and gradation. With respect to rock gathering data such as stratigraphy, lithology, structure and morphology has been found desirable. In the case of soils, the necessary information is usually determined by the Standard Penetration Test of Soils (STP) conducted in accordance with ASTM designation: D 1586-67 entitled "Standard Method For Penetration Test and Split-Barrel Sampling of Soils". In accordance with this standard, a drive weight assembly is specified which consists of a one hundred and forty pound weight, a driving head and a guide permitting a free fall of thirty inches. The lifting and dropping of the standard weight is usually accomplished by means of a winch which is part of a test boring drill machine.

Even though the standard penetration test is in general use and engineers have attempted to follow the criteria set forth in ASTM Standard D 1586-67, careful analysis of the results obtained have shown that the desired accuracy cannot always be guaranteed by using the presently employed methods due to such variables as inertia, friction of the winch, chattering of the weight along the guide rods as it drops and other inaccuracies inherent in the equipment.

SUMMARY OF THE INVENTION

The present invention relates generally to the field of penetration testing and sampling of soils and more particularly, is directed to a novel, automatic hydraulic hammer which employs hydraulic power to repeatedly raise a known weight through a given distance and to automatically drop the weight.

The present invention comprises a frame upon which a vertically acting hydraulic cylinder is secured. The frame incorporates a pair of opposed guide rods upon which a weight of one hundred and forty pounds is guided and freely retained for vertical, substantially frictionless reciprocation. The cylinder is connected to the hydraulic circuit of a conventional hydraulic feed test boring drill machine and the frame is conventionally secured to the machine in position to apply repeated, automatic blows to the test boring apparatus. Suitable mountings are provided to readily affix the unit to most presently available test boring drill machines so that the device can be made compatible for use with existing field apparatus.

A plunger is vertically reciprocal upon action of the hydraulic cylinder to raise the weight through a known distance for repeated applications. The plunger terminates downwardly in a lifting head which is secured to the weight by means of a pair of opposed spring clamps which serve to releasably secure the heavy weight to the plunger. The roof of the frame includes a pair of depending fingers which vertically align with the spring clamps and which pivot the clamps when the weight is brought to its uppermost point to automatically release the weight from association with the plunger. By providing an automatic hydraulic hammer, all chance for human error is avoided and the device will vertically function in response to the operation of the hydraulic cylinder and the clamp release fingers. Accordingly, a known weight will always be dropped precisely the same, known distance without human intervention to thereby provide a method for assuring greater accuracy in determining the desired "end" values (penetration resistance).

By the adoption of the automated device in accordance with the present application, human error is completely eliminated and as a result "values" would not differ from man to man and from machine to machine. All test results would be homogeneous and standardized throughout the entire soil engineering field. Thus, a soil engineer could design more efficiently without fear of faulty test results affecting his foundation designs.

It is therefore an object of the present invention to provide an improved automatic hydraulic hammer of the type set forth.

It is another object of the present invention to provide a novel automatic hydraulic hammer which is compatible for use with existing hydraulic drill rigs.

It is another object of the present invention to provide a novel automatic hydraulic hammer which is capable of repeatedly, automatically lifting and dropping a known weight through a known distance for soil penetration test purposes.

It is another object of the present invention to provide a novel automatic hydraulic hammer which includes a guide frame, a hammer which is reciprocal within the guide frame and which includes automatic release clamps and a hydraulic plunger releasably connected to the hammer at the clamps thereof, the said hydraulic plunger lifting the hammer in response to hydraulic power supplied by a drill rig.

It is another object of the present invention to provide a novel automatic hydraulic hammer which includes in combination a guide frame, a hydraulic cylinder mounted upon the frame, a plunger vertically reciprocal within the guide frame in response to function of the hydraulic cylinder, said plunger terminating downwardly in a weight attaching head, a weight being reciprocal within a guide frame and releasably connected to the head, the hammer including a pair of release clamps each having a connected position and a release position, the said clamps automatically gripping the head when the plunger is reciprocated to its lowest position and the clamps being automatically activated by guide positioned release fingers when the hydraulic cylinder powers the plunger to its uppermost position whereby the weight is automatically released for penetration test purposes.

It is another object of the present invention to provide an automatic hydraulic hammer that is rugged in construction, automated in operation and trouble free when in use. Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
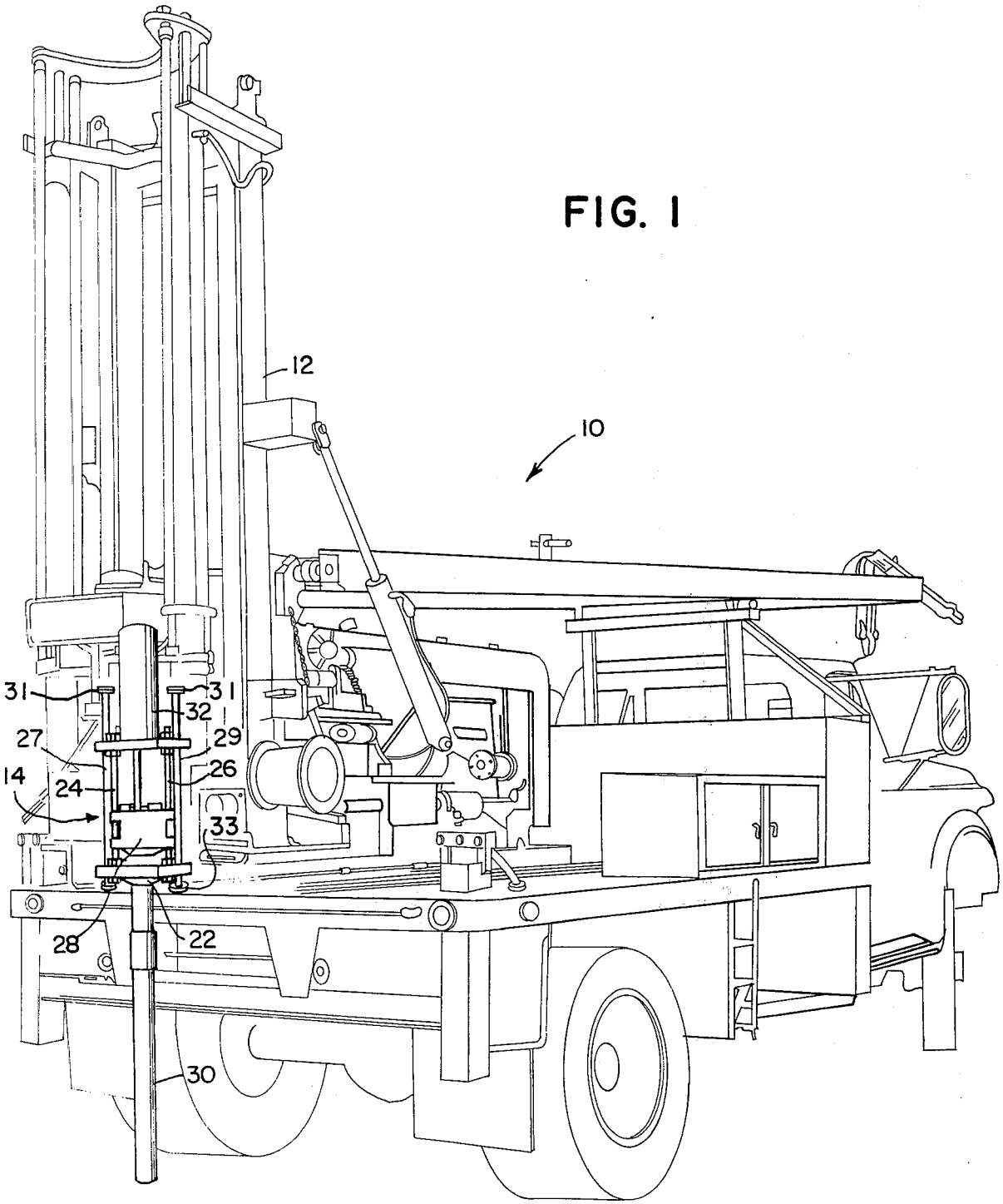
FIG. 1 is a perspective view of the automatic hydraulic hammer attached to a hydraulic feed test boring drill machine in position for use.

Although specific terms are used in the following description for the sake of clarity, these terms are intended to refer only to the particular structure of my invention selected for illustration in the drawings, and are not intended to define or limit the scope of the invention.

Referring now to the drawings, I show in FIG. 1 a modern hydraulic feed test boring machine 10 of conventional design incorporating a hydraulic system (not shown) and adjustable structure 12 to hold the usual test boring equipment. An automatic hydraulic hammer 14 affixes to the adjustable structure 12 by means of suitable mountings 16 which can be readily designed to function with all of the popular test machines 10 which are currently in use. The automatic hydraulic hammer 14 of the present invention is thus intended to be entirely compatible with existing field equipment.

Figures 2, 3, 4:
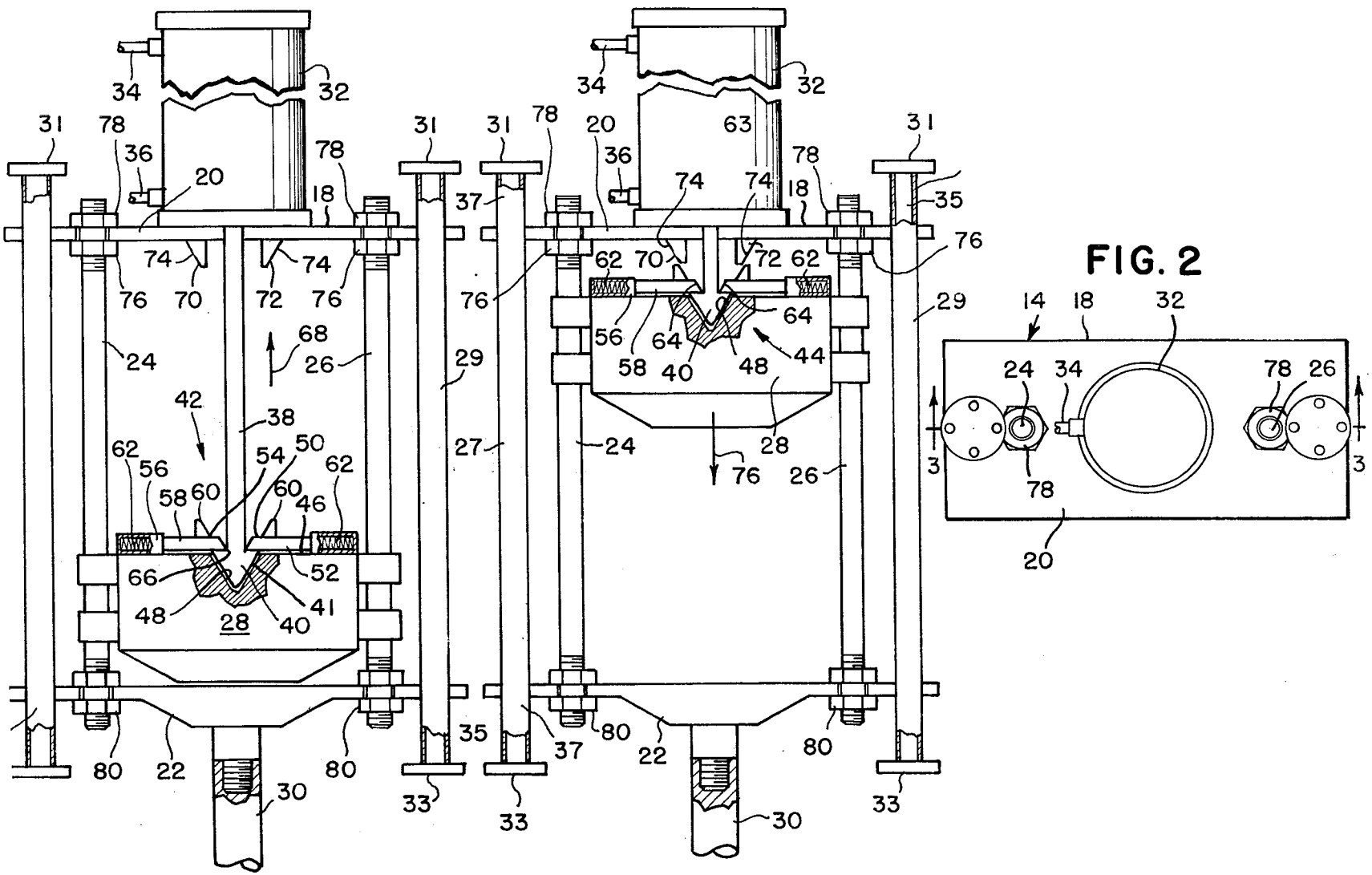
FIG. 2 is an enlarged, top plan view of the automatic hydraulic hammer illustrated in FIG. 1.
FIG. 3 is a sectional view taken along Line 3—3 of FIG. 2, looking in the direction of the arrows, partly in section and partly broken away to show details of interior construction.
FIG. 4 is a view similar to FIG. 3 showing the position of the hammer immediately after it reaches the upper limits of travel.

As best seen in FIGS. 2, 3 and 4, the automatic hydraulic hammer 14 includes a frame 18 of rigid construction employing a top yoke 20, a bottom support 22 and a pair of spaced, vertical guides 24, 26 interconnecting the top yoke 20 and the bottom support 22. A hammer 28, in the form of a precise one hundred and forty pound weight, is vertically reciprocal along the guides 24, 26 between the top yoke 20 and the bottom support 22 for penetration purposes using, for example, a split barrel sampler 30. A hydraulic cylinder 32 of conventional design mounts upon the top of the yoke 20 and is provided with hydraulic fluid inlet and outlet connections 34, 36 which connect into the hydraulic circuit (not shown) of the hydraulic test machine 10. The speed of operation of the automatic hydraulic hammer 14 depends upon the capacity of the hydraulic pump (not shown) which is already part of the test machine 10. The hydraulic cylinder 32 vertically reciprocates a plunger 38 for hammer lifting purposes in the manner hereinafter more fully set forth. The plunger 38 terminates downwardly in a hammer connecting means which may be an arrow-shaped head 40. The arroe-shaped head 40 is reciprocated between a lower, pick-up position 42 as illustrated in FIG. 3 to an upper, release position 44 as illustrated in FIG. 4. The top 46 of the hammer 28 is preferably provided with a centrally positioned, arrow-shaped recess 48 which is designed to receive therein the plunger head 40 in relatively tight engagement when the plunger 38 is activated to its pick-up position 42. The arrow-shaped recess 48 serves both to center the head 40 relative to the hammer 28 and also to prevent relative movement between the parts during all periods of operation when the parts are normally associated.

A pair of spaced, vertical sleeves 27, 29 interconnect the top yoke 20 and the bottom support 22 in a manner to allow the frame 18 to move vertically downwardly for sampler 30 driving purposes upon repeated operational blows delivered by the hammer 28. A pair of spaced slide rods 35, 37 vertically slide within the respective sleeves 27, 29 and terminate upwardly in the connecting flanges 31. The rods 35, 37 terminate downwardly in the bottom flanges 33. Accordingly, the frame 18 is free to travel along the slide rods 35, 37 upwardly a distance equal to the spaces between the top yoke 20 and the top flanges 31 and downwardly a distance equal to the spaces between the bottom support 22 and the bottom flanges 33.

The top surface 46 of the hammer 28 is provided with a quick release means 52 which is illustrated as including a pair of diametrically opposed clamps 50, 54 which are each fixedly secured to the top surface 46 of the hammer 28 in conventional manner, such as by bolting or welding. The clamps should be of adequate strength to withstand the rigors of repeated field use without breaking or other permanent deformation. Each clamp 50, includes a spring housing 56 and a plunger 58 which is reciprocal within the housing. A compression spring 62 is carried within each housing 56 and continuously biases the plungers 58 in a direction to continuously engage the plunger head 40 at the shoulder 66 thereof.

Each clamp 50, 54 terminates inwardly in a holding end 64 which removable secures against the shoulder 66 which is defined between the arrow-shaped head 40 and the plunger body 38. The arrow-shaped head 40 includes a lower, inclined, cam surface 41 which slides over the inclined ends 63 of the clamps 50, 54 when the plunger is reciprocated from the release position 44 as in FIG. 4 to the pick-up position 42 as illustrated in FIG. 3. Thus, when the hydraulic cylinder 32 functions the plunger 38 to its pick-up position 42, (FIG. 3), the holding ends 64 of the clamps 50, 54 are urged into holding contact against the shoulder 66 of the arrow-shaped head 40 by action of the springs 62 which function to bias the respective clamps 50, 54 toward the plunger 38. It will be noted that the arrow-shaped recess 48 serves to center the head 40 to assure that the shoulder 66 will always be properly positioned for clamping engagement with the holding ends 64 of the respective clamps 50, 54.

Engagement of the holding ends 64 of the clamps 50, 54 with the shoulder 66 is assured at all times by action of the coil springs 62 which bias against the rear of the housing 56 to thereby prevent accidental disengagement of the hammer from the plunger 38. With the clamps 50, 54 properly secured to the arrow-shaped head 40 at the shoulder 66, the hydraulic cylinder 32 is functioned by action of the test machine 10 to raise the hammer 28 in the direction of the arrow 68.

As best seen in FIGS. 3 and 4, the top yoke 20 of the frame 18 is equipped with clamp release means which may be in the form of a pair of transversely outwardly positioned depending fingers 70, 72 which vertically register over the respective upwardly positioned, inclined face triggers 60 of the clamps 50, 54. The inclined bottom surface 74 of the fingers 70, 72 precisely terminate the exact desired distance above the bottom support 22 of the frame 18 for test purposes, such as, for example exactly 30 inches, as may be dictated by the test procedure being followed, for example, ASTM standard test designation D 1586-67. Of course, should an alternate test standard specify a different distance, the distance between the inclined bottom surfaces 74 of the fingers 70, 72 and the bottom frame support 22 can be readily varied as may be necessary or desired. The threaded nuts 76, 78 permit precise adjustment of the spacing between the top yoke 20 and the bottom support 22 for varying the length of travel of the hammer 28.

When the cylinder 32 functions to pull the plunger 38 to its uppermost limit of travel, the arrow-shaped head 40 acts in conjunction with the clamps 50, 52 to raise the hammer 28 upwardly until the triggers 60 of the clamps 50, 54 strike the bottom inclined surfaces 74 of the fingers 70, 72. The action of the fingers 70, 72 against the triggers 60 pushes the plungers outwardly in the direction to compress the coil springs 62. See FIG. 4. The movement of the triggers 60 into the housings 56 urges the respective holding ends 64 sufficiently outwardly away from contact with the shoulder 66 of the head 40 to thereby quickly and positively disengage the hammer 28 from the plunger 38. The quick release of the clamps 50, 54 from the shoulder 66 automatically allows the hammer to fall by gravity in the direction of the arrow 77 for test drive purposes. As previously stated, the frame 18 is so constructed and dimensioned as to permit the hammer 28 to fall only a predetermined distance, as for example, a precise thirty inch test fall. After the hammer has fallen to the position illustrated in FIG. 3, the hydraulic cylinder 32 is again actuated by the test machine 10 to drive the plunger 38 downwardly to again engage the hammer 28 as in FIG. 3 by interaction of the clamps 50, 54 and the plunger shoulder 66.

Although I have described the present invention with reference to the particular embodiments therein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In an automatic hydraulic hammer suitable for use with a hydraulic feed test boring machine having a hydraulic circuit, the combination of A. a frame defining an interior space,

1. said frame including a top yoke, a bottom support which is vertically spaced the yoke and vertical guides interconnecting the top yoke and bottom support;

B. a hydraulic cylinder connected into the hydraulic circuit and affixed to the top yoke,

1. said cylinder vertically reciprocating a plunger within the space between an upper position and a lower position,

2. said plunger including a body which terminates downwardly in a hammer connecting means to removably attach the plunger to the hammer,

3. said hammer connecting means including an arrow-shaped head, a. the arrow-shaped head being formed with a lower, inclined, cam surface, the said surface contacting the quick release means when the plunger falls to its said lower position;

C. a hammer being vertically reciprocal within the space,

1. said hammer vertically sliding upon the glides,

2. said hammer being upwardly defined by a top surface;

D. quick release means affixed to the top surface of the hammer to interact with the hammer connecting means for hammer lifting and releasing purposes; and E. clamp release means affixed to the top yoke to function the quick release means when the plunger is urged to its said upper position.

2. The invention of claim 1 wherein the arrow-shaped head defines a shoulder between the head and the plunger body, the said shoulder being releasably gripped by the quick release means when the plunger moves to the said lower position to releasably connect the hammer to the plunger for hammer lifting purposes.

3. The invention of claim 2 wherein the quick release means includes a member having reciprocal movement relative to the top surface of the hammer.

4. The invention of claim 3 wherein the quick release means includes an elongate clamp including a plunger, said plunger terminating inwardly in a holding end and outwardly in a spring end, said holding end releasably engaging the said shoulder to interconnect the hammer to the plunger for hammer lifting purposes.

5. The invention of claim 4 and a spring biasing the spring end of the plunger, said spring continuously biasing the plunger inwardly to urge the holding end into engagement with the shoulder.

6. The invention of claim 5 wherein the clamp release means include a finger depending from the top yoke, and a trigger upwardly projecting from the plunger, said finger vertically registering above the trigger, said finger being contacted by the trigger when the plunger is activated to its upper position, said finger urging the plunger in a direction opposite to the direction urged by the spring bias, said finger and trigger cooperating to compress the spring to release the holding end from the shoulder whereby the hammer is automatically released from the plunger when the plunger reaches its said upper position.

7. The invention of claim 6 wherein the top surface of the hammer is provided with a depressed area in registry with the plunger, said depressed area being of sufficient size to receive the said arrow-shaped head when the plunger is activated to its said lower position, the said holding end of the plunger engaging upon the shoulder when the arrow-shaped head enters the recess.

8. The invention of claim 7 wherein the recess is formed to the same arrow-shaped configuration as the arrow-shaped head and of size to tightly receive the arrow-shaped head therein, whereby the recess guides the head into position when the plunger reaches its lower position and prevents relative movement between the plunger and the hammer during all periods of operation when the plunger is normally associated with the hammer.

* * * * *